US005884349A

United States Patent [19]

Gretsinger

[11] Patent Number: 5,884,349

[45] Date of Patent: Mar. 23, 1999

[54] TOP AND BOTTOM BEDSHEET COMBINATION HAVING A STRETCHABLE CONNECTOR BAND

[76] Inventor: Joyce A. Gretsinger, 4711 Rainer Ct., Sylvania, Ohio 43560

[21] Appl. No.: 984,911

[22] Filed: Dec. 4, 1997

[51] Int. Cl.[6] ..... A47G 9/02

[52] U.S. Cl. ..... 5/502; 5/497; 5/498; 5/494

[58] Field of Search ..... 5/485, 494, 496, 5/497, 498, 502

[56] References Cited

U.S. PATENT DOCUMENTS

| | | | |
|---|---|---|---|
| 2,662,234 | 12/1953 | Citron . | |
| 2,799,870 | 7/1957 | Sullivan . | |
| 3,013,283 | 12/1961 | Steffinich . | |
| 3,467,974 | 9/1969 | Deutsch . | |
| 3,832,743 | 9/1974 | Smith . | |
| 3,855,655 | 12/1974 | Propst . | |
| 3,868,735 | 3/1975 | Ross . | |
| 4,035,854 | 7/1977 | Pardee . | |
| 4,095,300 | 6/1978 | Ruben . | |
| 4,145,778 | 3/1979 | Ferrante et al. . | |
| 4,245,365 | 1/1981 | Large . | |
| 4,266,308 | 5/1981 | Shatz | 5/494 |
| 4,344,196 | 8/1982 | Large . | |
| 4,370,765 | 2/1983 | Webber . | |
| 4,384,380 | 5/1983 | Glaha et al. . | |
| 4,389,744 | 6/1983 | Monroe . | |
| 4,402,098 | 9/1983 | McClam | 5/494 |
| 4,488,323 | 12/1984 | Colburn . | |
| 4,494,262 | 1/1985 | Robertson . | |
| 4,615,061 | 10/1986 | Scott | 5/497 |
| 4,662,016 | 5/1987 | Seeman . | |
| 4,672,702 | 6/1987 | Isham | 5/497 |
| 4,682,379 | 7/1987 | Dugan . | |
| 4,727,608 | 3/1988 | Joyce . | |
| 4,802,251 | 2/1989 | O'Dell . | |
| 4,833,744 | 5/1989 | Correa . | |
| 4,884,305 | 12/1989 | Blackmon . | |
| 4,899,407 | 2/1990 | McCue . | |
| 4,964,184 | 10/1990 | Lewis . | |
| 5,020,177 | 6/1991 | Etherington . | |
| 5,027,460 | 7/1991 | Honig . | |
| 5,134,736 | 8/1992 | Anthony et al. . | |
| 5,142,718 | 9/1992 | Anderson et al. . | |
| 5,165,128 | 11/1992 | Honig . | |
| 5,177,821 | 1/1993 | Kawtoski . | |
| 5,208,926 | 5/1993 | Stackhouse . | |
| 5,208,927 | 5/1993 | Lachmar . | |
| 5,557,814 | 9/1996 | Cybulski | 5/496 |

*Primary Examiner*—Michael F. Trettel
*Attorney, Agent, or Firm*—MacMillan, Sobanski & Todd, LLC

[57] ABSTRACT

A bedsheet combination includes a bottom sheet having a foot end, a top sheet having a foot end, and a connector band of stretchable fabric secured between the bottom sheet and the top sheet to attach the foot end of the top sheet to the foot end of the bottom sheet. The connector band has a first edge attached to the foot end of the bottom sheet and has a second edge attached to the foot end of the top sheet. The connector band enables the foot end of the top sheet to be pulled away from the foot end of the bottom sheet while being urged to return in the direction of the foot end of the bottom sheet.

20 Claims, 5 Drawing Sheets

TOP AND BOTTOM BEDSHEET COMBINATION HAVING A STRETCHABLE CONNECTOR BAND

BACKGROUND OF THE INVENTION

This invention relates in general to a bedsheet combination and in particular, to a top sheet and a bottom sheet combination having a stretchable connector band secured between them for maintaining the top sheet secured to the bottom sheet while accommodating stresses between the top sheet and the bottom sheet.

A recent trend in bedding systems is to provide various combinations of one or more bedsheets, mattress pad, blanket, or comforter that are secured together in some manner. These combinations have been provided for a number of reasons, including ease of making the bed and keeping the bed made. In the past various means have been used to secure bedsheets other bedding layers to the mattress. For example, U.S. Pat. No. 4,682,379 to Dugan discloses the use of a stretchable material such as LYCRA® material applied to the joint where the bottom edges of the bottom sheet and bed pad are sewn together. The purpose of the stretchable material is to impart a lateral contraction to hold the bottom sheet and bed pad on the bed, rather than as a link from the bottom edge of the top sheet to the bottom edge of the bed pad.

U.S. Pat. No. 4,662,016 to Seeman discloses elastic straps for elastically holding the bedclothes onto the bed. The straps are tied together at their base end, between the mattress and the box springs, by Velcro attachments. The outward ends of the straps include a clip for attachment to the bedclothes. The straps are discontinuous and laterally spaced apart, and are each linked to the attachment system (Velcro, etc.), and are not linked to each other. Also, the straps are not permanently attached to the bedclothes.

One combination that has grown in popularity is a fitted or contoured bottom sheet which is secured to a top sheet. Typically, the top sheet is permanently secured to the bottom sheet such that relative movement between the top sheet and the bottom sheet at the foot of the bed is not permitted. For example, stitching, buttons, zippers, non-elastic straps, and hook and loop-type fasteners have been used to attach the top sheet to the bottom sheet to prevent relative movement between the two sheets.

These securement methods are deficient because the top sheet applies pressure on the person's feet and does not allow movement of the top sheet from the foot or base of the top sheet to relieve the pressure. Further, when the person in the bed rolls over, wiggles or otherwise moves in the bed, there is no flexibility to absorb stresses on the bedsheets. As a result of this lack of accommodation for movement of the bedsheets, the top sheet and the bottom sheet can both be pulled out from the crevice between the upper and lower mattresses at the foot of the bed, thereby defeating the purpose of providing the combined top and bottom sheet. Another possible result of this lack of accommodation for movement of the bedsheets is that the top sheet can be pulled down to an unacceptable position, uncovering the upper part of the user's body. Also, the stresses applied to the stitching at the foot of the bed where the top sheet is joined to the bottom sheet can serve to rip or pull out the stitching.

A number of solutions have been proposed for providing relative movement of the top sheet so as to alleviate pressure on the person's feet. For example, it is known to attach one or more removable straps having an elastic portion to the top sheet and secure the other end of the strap between the mattress and the box spring or the bed frame. This method is not very convenient in that it requires one or more additional steps to make the bed beyond applying the bottom and top sheets on the bed. Ideally, it would be desirable to provide a top and bottom bedsheet combination that is both easy to apply on the bed and that allows movement of the top sheet from the position where it is secured to the bottom sheet. This would allow the top sheet to be pulled out by the bed user and yet still be tied to the bottom sheet for relatively easy remaking of the bed.

SUMMARY OF THE INVENTION

The above objects as well as other objects not specifically enumerated are achieved by a bedsheet combination that includes a bottom sheet having a foot end, a top sheet having a foot end, and a connector band of stretchable fabric secured between the bottom sheet and the top sheet to attach the foot end of the top sheet to the foot end of the bottom sheet. The connector band has a first edge attached to the foot end of the bottom sheet and has a second edge attached to the foot end of the top sheet. The connector band enables the foot end of the top sheet to be pulled away from the foot end of the bottom sheet while being urged to return in the direction of the foot end of the bottom sheet.

In a specific embodiment of the invention, the connector band of the bedsheet combination has both an end panel and a first side panel. In this embodiment the bedsheet combination includes a bottom sheet having a first side edge and a foot end, a top sheet having a first side edge and a foot end, and a connector band of stretchable fabric secured between the bottom sheet and the top sheet to attach the foot end of the top sheet to the foot end of the bottom sheet and to attach the first side edge of the top sheet to the first side edge of the bottom sheet. The end panel of the connector band has a first edge attached to the foot end of the bottom sheet and has a second edge attached to the foot end of the top sheet. The side panel of the connector band has a first panel edge attached to the first side edge of the bottom sheet, and the side panel of the connector has a second panel edge attached to the first side edge of the top sheet. The connector band enables the foot end of the top sheet to be pulled away from the foot end of the bottom sheet while being urged to return in the direction of the foot end of the bottom sheet, and enables the first side edge of the top sheet to be pulled away from the first side edge of the bottom sheet while being urged to return in the direction of the first side edge of the bottom sheet.

In another specific embodiment of the invention, the connector band of the bedsheet combination has an end panel, a first side panel and a second side panel. In this embodiment the bedsheet combination includes a bottom sheet having a first side edge, a second side edge and a foot end. The top sheet has a first side edge, a second side edge and a foot end. The connector band of stretchable fabric is secured between the bottom sheet and the top sheet to attach the foot end of the top sheet to the foot end of the bottom sheet, to attach the first side edge of the top sheet to the first side edge of the bottom sheet, and to attach the second side edge of the top sheet to the second side edge of the bottom sheet. The end panel of the connector band has a first edge attached to the foot end of the bottom sheet and has a second edge attached to the foot end of the top sheet. The first side panel of the connector band has a first panel edge attached to the first side edge of the bottom sheet, and the first side panel of the connector band has a second panel edge attached to the first side edge of the top sheet. The second side panel of the connector band has a first panel edge attached to the second side edge of the bottom sheet, and the second side panel of the connector has a second panel edge attached to the second side edge of the top sheet. The connector band enables the foot end of the top sheet to be pulled away from the foot end of the bottom sheet while being urged to return in the direction of the foot end of the bottom sheet, and enables the first side edge of the top sheet to be pulled away from the first side edge of the bottom sheet while being urged to return in the direction of the first side edge of the bottom sheet, and enables the second side edge of the top sheet to be pulled away from the second side edge of the bottom sheet while being urged to return in the direction of the second side edge of the bottom sheet.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
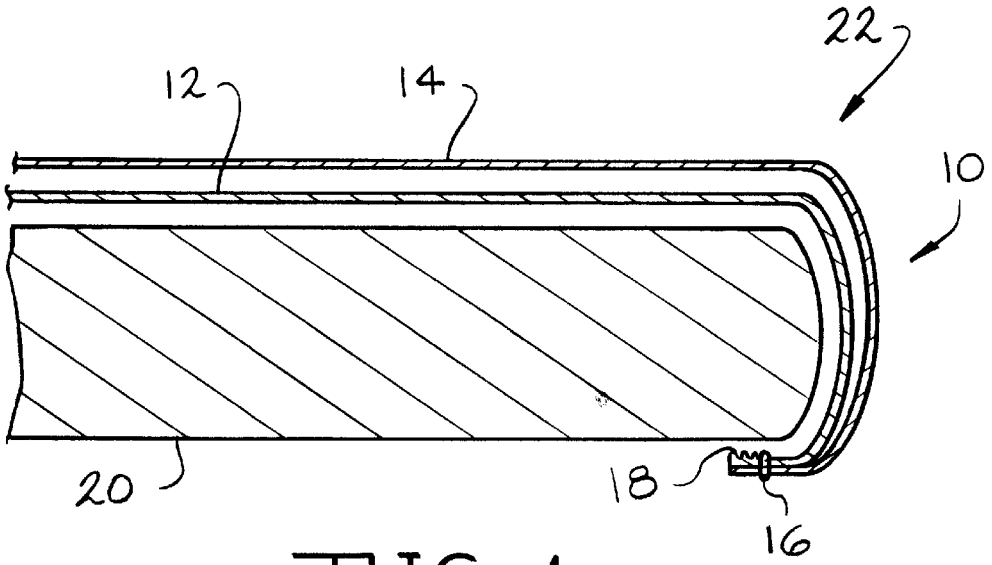
FIG. 1 (PRIOR ART)
FIG. 1 is a schematic cross-sectional view of a top and bottom sheet combination in accordance with the prior art.

Referring now to the drawings, there is illustrated in FIG. 1 a secured top sheet and bottom sheet combination, indicated generally at 10, in accordance with the prior art. As shown, this combination 10 includes a bottom sheet 12 and a top sheet 14 which are secured together by an inflexible fastening means, such as stitching 16. It is also known to use buttons, zippers, or hook and loop-type fasteners as the fastening means 16. Typically, the bottom sheet 12 is configured as a fitted or contoured sheet to hold the bottom sheet 12 on the top mattress 20. It is known that in a top sheet and bottom sheet combination, the top sheet 14 can be configured as a fitted sheet, to conform to the shape of the bottom sheet at the foot end 22 of the bed.

Figure 2:
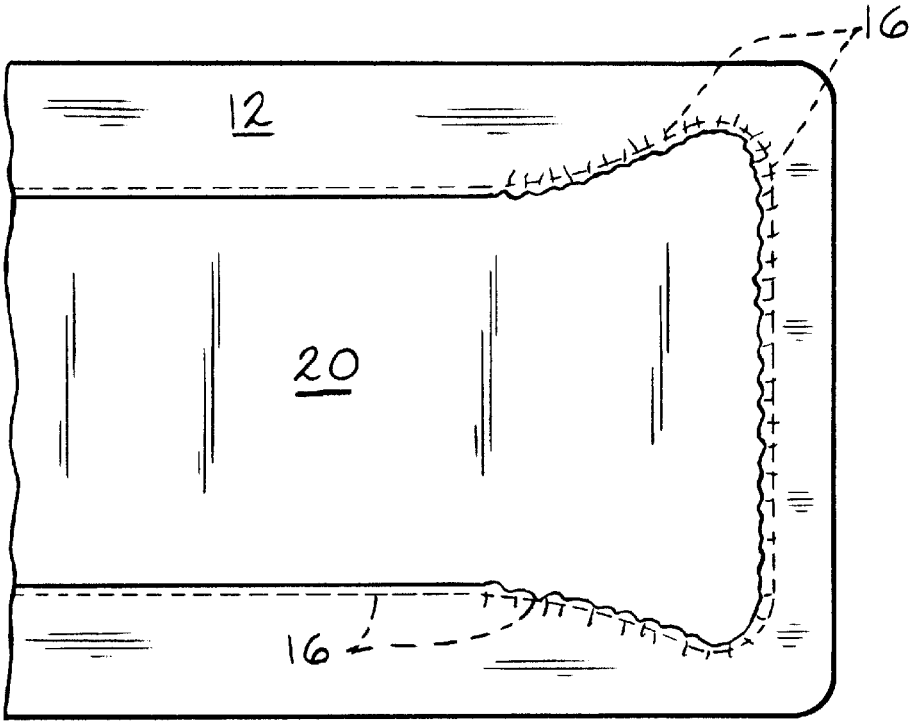
FIG. 2 (PRIOR ART)
FIG. 2 is a plan view of a contoured bottom sheet in accordance with the prior art, when viewed from the bottom of the mattress.

As shown in FIG. 2, it is known that by attaching a relatively narrow elastic strip 18 around the entire perimeter of the bottom sheet, or around only a portion of the bottom sheet, the bottom sheet can be fitted to the mattress and secured so that it won't easily be pulled off.

Figure 3:
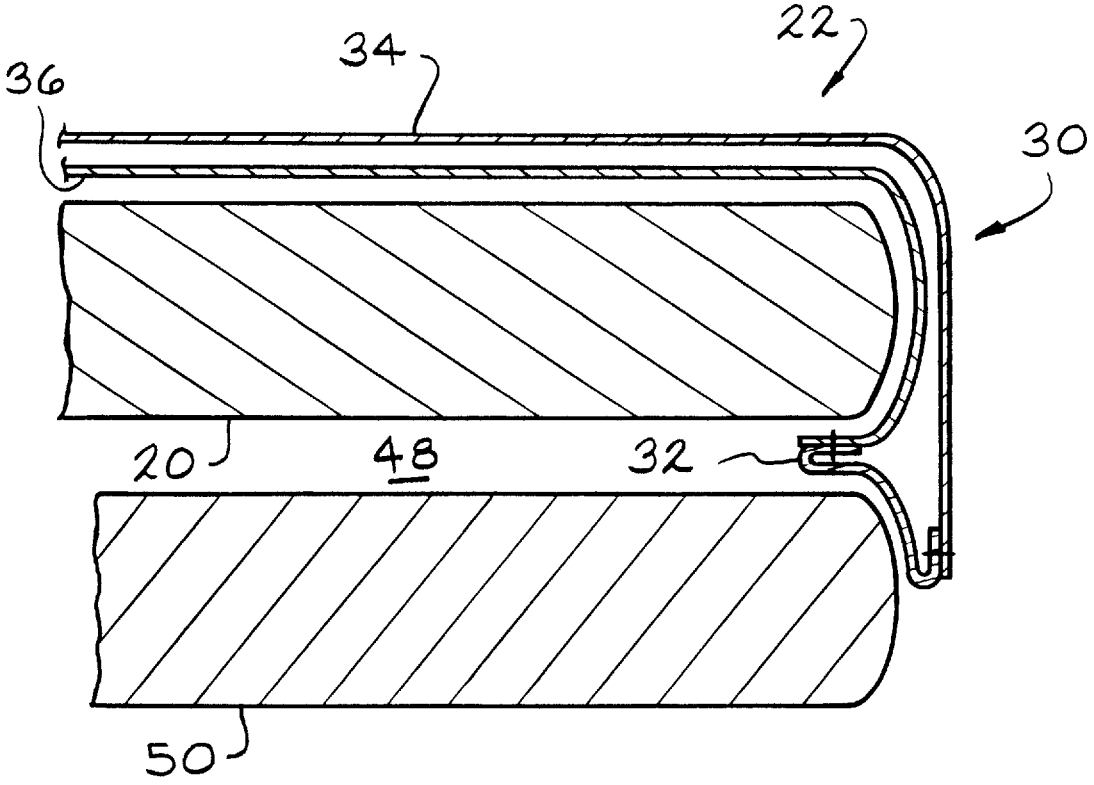
FIG. 3 is a schematic cross-sectional view of a top and bottom bedsheet combination in accordance with the present invention.
Figure 4:
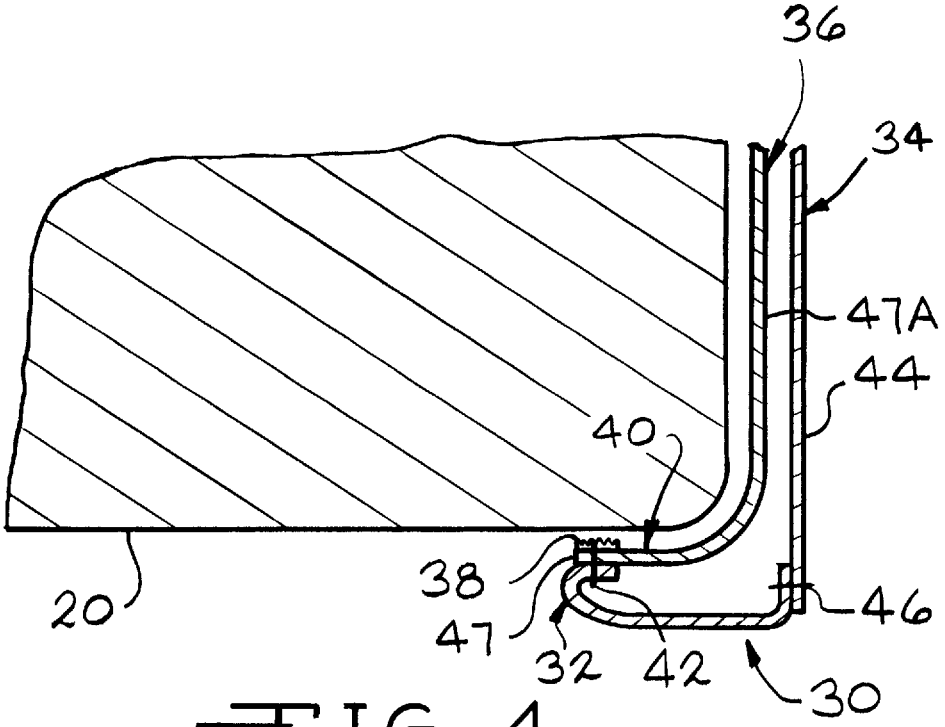
FIG. 4 is an enlarged view of the connection between the top sheet and the bottom sheet of FIG. 3.

Referring now to FIGS. 3 and 4, there is illustrated a top and bottom bedsheet combination, indicated generally at 30, in accordance with this invention. The top and bottom bedsheet combination 30 of this invention overcomes the problems described above by using a connector band 32 of stretchable material to secure the top sheet 34 to the bottom sheet 36. The bottom sheet 36 fits relatively snugly against the mattress 20 with the top sheet 34 being positioned above the bottom sheet 36. The bottom sheet 36 is formed into a fitted or contoured sheet and held in place on the mattress 20 by means of an elastic strip 38, which can be sewn in place. The connector band 32 is sewn to the foot end 40 of the bottom sheet by stitching 42, and is sewn to the foot end 44 of the top sheet 34 by another row of stitching 46. The connector band 32 allows relative movement of the top sheet 34 from the positions where the top sheet 34 is secured to the bottom sheet 36. When the bed is normally made, the foot end 40 of the bottom sheet 36 is tucked into the space or crevice 48 between the mattress 20 and the box springs 50. Although the connector band 32 is shown as being attached to the extreme distal end 47 of the foot end 40 of the bottom sheet, it is to be understood that the connector band 32 could be connected to the foot end 40 at a point higher up on the foot end 40, such as mid point 47A, and still be effective in retaining the top sheet in place according to this invention.

Figure 5:
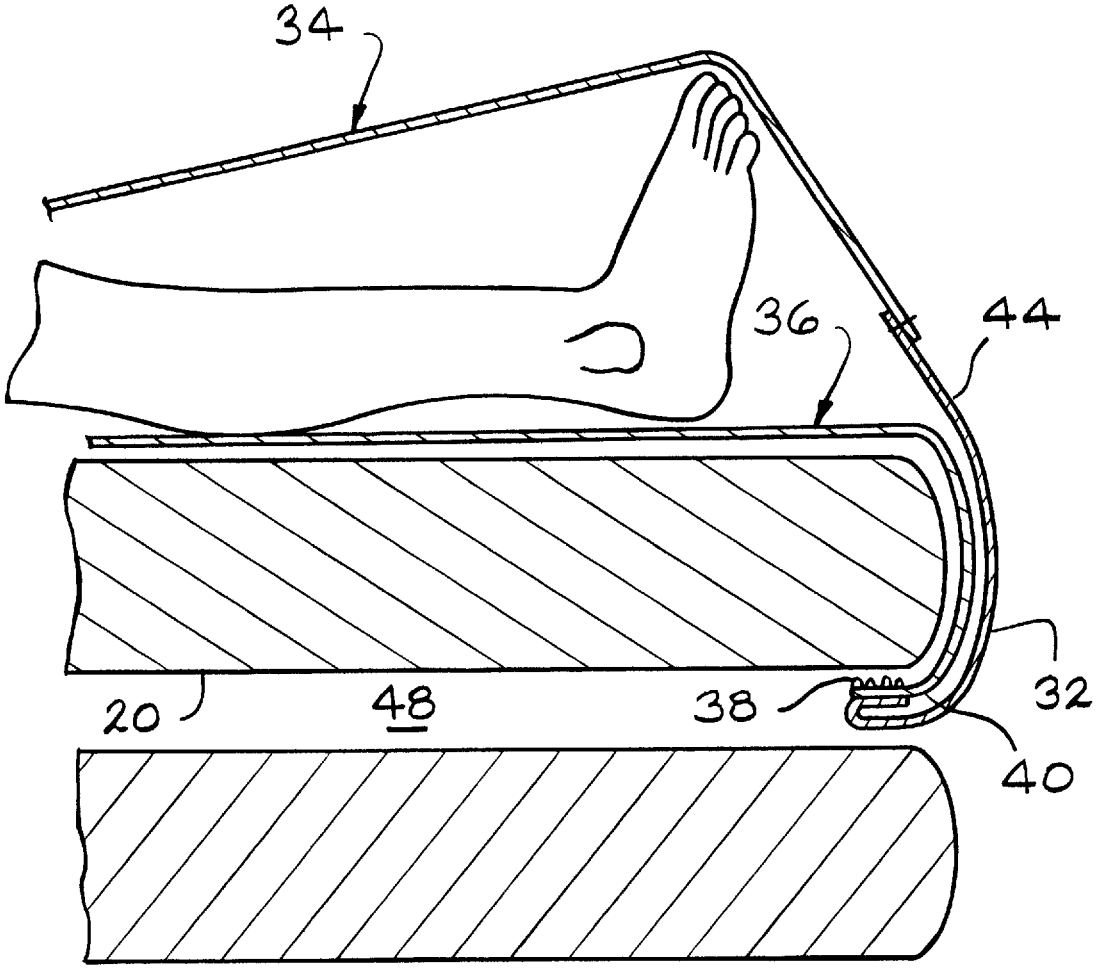
FIG. 5 is a view similar to that of FIG. 4, except that the connector band is shown in a stretched position.

As shown in FIG. 5, when the foot end 44 of the top sheet 34 is pulled out from the crevice 48 between the mattress 20 and the box springs (not shown in FIG. 5), the connector band 32 stretches to allow the top sheet to move relative to the mattress 20 and yet still be connected to the bottom sheet 36. It can be seen that the foot end 40 of the bottom sheet 36 remains tucked in the crevice 48, held in place by the elastic strip 38.

Figure 6:
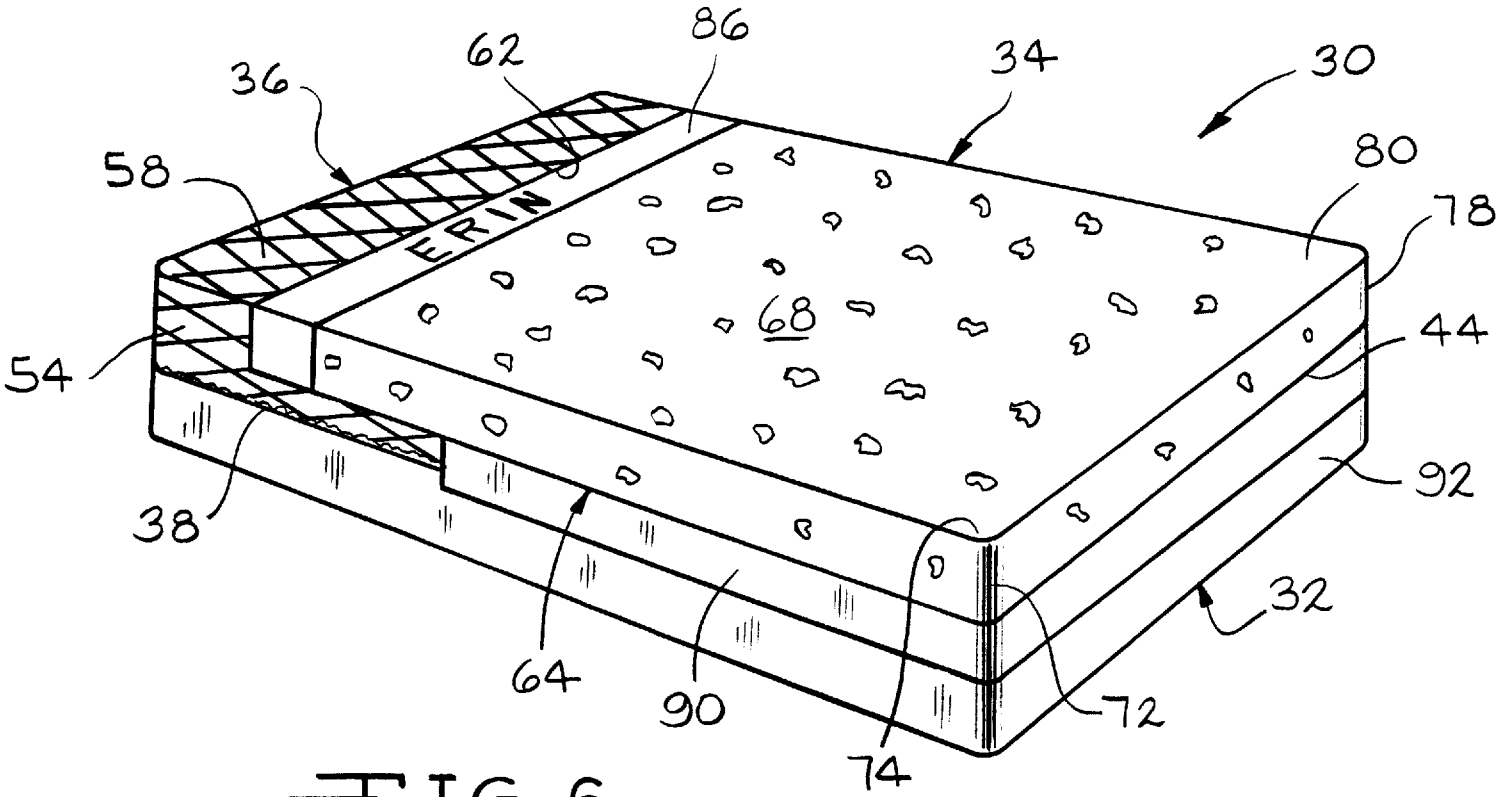
FIG. 6 is a perspective view of the top and bottom bedsheet combination shown in FIG. 3.
Figure 7:
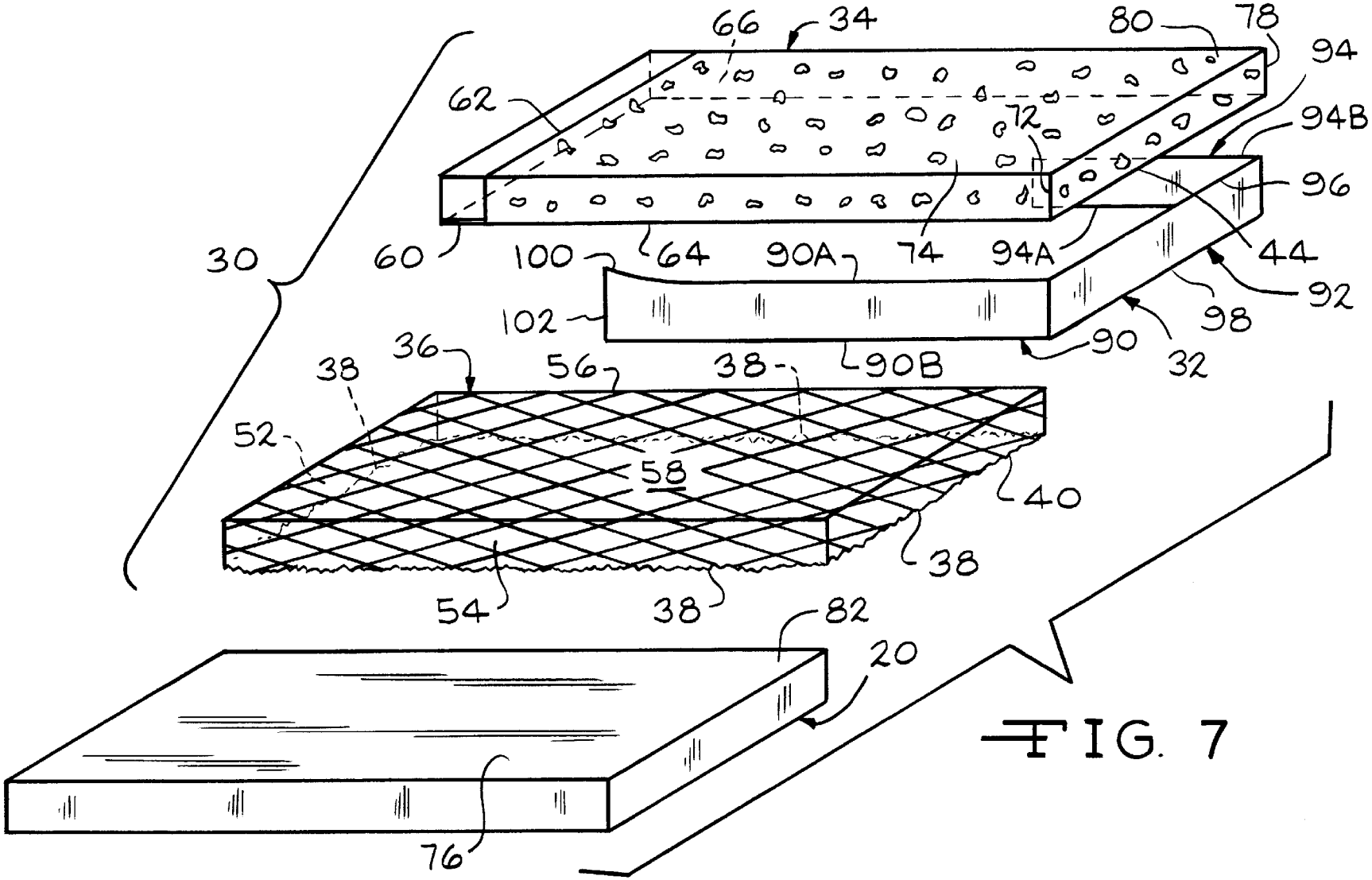
FIG. 7 is an exploded perspective view of the top and bottom bedsheet combination shown in FIG. 6.

A more detailed view of the top and bottom bedsheet combination 30 in accordance with this invention is illustrated in FIGS. 6 and 7. In these figures, the top sheet 34 is shown having a flower pattern imprinted thereon and the bottom sheet 36 is shown having a crisscross stripe pattern imprinted thereon. These patterns are provided only as an aid in illustrating and understanding the invention and therefore, form no part of this invention. The bottom sheet 36 is a generally rectangular piece of fabric having a head end 52 (shown in phantom), a first side edge 54, the foot end 40, a second side edge 56 (shown in phantom), and a top or outside surface 58. The bottom sheet 36 is configured as a fitted or contoured sheet which is held against the mattress 20 with the elastic strip 38. The elastic strip 38 is optional, but preferably is used to hold the bottom sheet on the bed. The elastic strip 38 can extend around the entire perimeter of the bottom sheet 36, as shown, or can be sewn around a portion of the perimeter, such as at the corners. Preferably, the bottom sheet 36 is made with the outside surface 58 as the finished side of the fabric, although such is not necessary.

The top sheet 34 is also a generally rectangular piece of fabric having a head end 62, a first side edge 64, the foot end 44, a second side edge 66 (shown in phantom in FIG. 7), a top or outside surface 68, and an inside surface 70. A first seam 72 may be provided in the corner located between the first side edge 64 and the foot end 44 of the top sheet 34 to form a first pocket 74 adapted to fit a corner 76 of the mattress 20. A second seam 78 may be provided in the corner located between the second side edge 66 and the foot end 44 to form a second pocket 80 adapted to fit an adjacent comer 82 of the mattress 20. Preferably, the top sheet 34 is made such that the outside surface 68 is the finished side of the fabric, although such is not necessary.

Additionally, the top sheet 34 may have a section of fabric to serve as a decorative flap 86 secured at the head end 62 of the top sheet. This decorative flap which can be placed over a blanket (not shown) or other bedding component when the bed is made. Preferably, the flap 86 is constructed such that both its top and bottom surfaces are made from the finished side of a fabric, although such is not necessary. Optionally, the flap 86 may be provided with an insignia such as a name or monogram to personalize the bedsheet combination 30.

The stretchable connector band 32 is an elongate, continuous piece of fabric which includes a first side panel 90, an end panel 92 and a second side panel 94. Preferably, the width of each of the three panels, 90, 92 and 94, is generally constant so that each of the panels is generally rectangular. The first side panel 90 secures the first side edge 64 of the top sheet 34 to the aligned first side edge 54 of the bottom sheet 36. The first side panel has a first side panel edge 90A attached to the first side edge 64 of the top sheet, and has a first side panel edge 90B attached to the first side edge 54 of the bottom sheet. These attachments can be made by sewing, or other means of attachment.

The end panel 92 has two edges, 96 and 98. The end panel 92 secures the foot end 44 of the top sheet 34 to the foot end 40 of the bottom sheet 36. This is accomplished by attaching the edge 96 to the foot end 40 of the bottom sheet, and by attaching the edge 98 to the foot end 44 of the top sheet.

The second side panel 94 secures the second side edge 66 of the top sheet 34 to the aligned second side edge 56 of the bottom sheet 36. The second side panel has a second side panel edge 94A connected to the second side edge 66 of the top sheet, and has a second side panel edge 94B attached to the second side edge 56 of the bottom sheet. Preferably, the connector band 32 is secured to both the top sheet 34 and the bottom sheet 36 by stitching, although other relatively permanent fastening methods that are suitable for fabric, such as adhesive bonding, can be used.

It is to be understood that the connector band can be provided with just the end panel 92, without any side panels 90 and 94, although the side panels improve the operation of the bedsheet combination 30. Also, the connector band can be provided with the end panel 92 and one side panel 90. Further, although the connector band is shown as being continuous, it is to be understood that the band could be configured as a series of smaller, intermittent or spaced apart panels, not shown.

In the embodiment of the invention shown in FIG. 7, the first side panel 90 of the stretchable connector band 32 has a length which is greater than the length of the second side panel 94, although such is not necessary. The length of the first side panel 90 can vary, but preferably is within the range of from about 25 percent to about 80 percent of the length of the bottom sheet. Preferably, the length of the first side panel 90 is about 1.5 to about 5 times the length of the second side panel 94. More preferably, the length of the first side panel 90 is about 4 times the length of the second side panel 94. For example, when the top and bottom bedsheet combination 30 of this invention is configured for use with a twin size mattress 20 having an overall length of about 72 inches, the length of the first side panel 90 is about 40 to 50 inches while the length of the second side panel 94 is about 6 to 12 inches. As will be apparent to one skilled in the art, the total length of the connector band 32 may be varied depending on the size of the mattress (i.e. twin, fill, queen, or king) with which the bedsheet combination 30 will be used.

Preferably, the width of the band 32 is generally constant over its length, although such is not necessary. The width of the band at the end panel 92 would be the distance from edge 96 to edge 98. The width of the band 32 may be varied based on the fabric used to make the band 32 and the width of the mattress 20. Preferably, the width of the band is within the range of from about 2 inches to about 12 inches, when not stretched or extended. An optional feature of the invention is a flaring or widening of the longer first side panel 90 of the stretchable band 32 to form a flared portion 100 at the end 102 of the first side panel that is farthest away from the foot end 22 of the bed. As shown in FIG. 7, the flared portion 100 provides additional stretchable fabric in the connector band to accommodate the increased stresses where the top sheet and bottom sheet are joined together. In a preferred design, the flared portion 100 increases the unstretched width of the connector band from a width of about seven inches to a width of about nine inches. Preferably, the flaring will begin gradually at a distance of about twelve inches from the end 102 of the first side panel 90, although other sizes and shapes for the flared portion 100 can be used.

In a preferred embodiment of the invention, the connector band 32 is made from a stretchable fabric. Fabrics suitable for use in this invention include, but are not limited to, fabrics made of natural fibers such as cotton, and synthetic fibers such as polyester, nylon, and the elastic-based materials such as spandex, LYCRA® and SPANDEXTRA® brand fibers, and combinations and blends of any of these fibers. Preferably, the fabric used in making the stretchable connector band 32 contains about 50% or less of an elastic-based material. More preferably, the fabric for the band 32 includes about 90% polyester and about 10% of an elastic based material. Most preferably, the elastic-based material is made from SPANDEXTRA® material. A preferred fabric for the connector band will be stretchable to increase its width by an amount within the range of from about 50 percent to about 150 percent of the original width, More preferably, the connector band fabric will be stretchable by an amount within the range of from about 75 percent to about 125 percent of the original width. Most preferably, the connector band fabric will be stretchable by about 100 percent.

This invention is particularly well suited for daybeds and other beds which are positioned against a wall. In these configurations, one side of the bed is blocked by the wall (not shown) or bed frame (not shown). Accordingly, the top and bottom;bedsheet combination 30 of this invention is positioned on the bed such that the longer, first side panel 90 of the connector band 32 is positioned against the wall or bed frame, thereby leaving the shorter second side panel 94 on the side of the bed from which the person enters or exits the bed. In this manner, the top sheet 34 can easily be pulled back for entry and exit, while the longer first side panel 90 of the stretchable band 32 helps to ensure that the top sheet 34 is not pulled out on the side of the bed adjacent the wall or bed frame.

In operation, the top and bottom bedsheet combination 30 of this invention allows movement of the top sheet 34 while ensuring that both the top sheet 34 and the bottom sheet 36 remain positioned on the bed. As shown in FIGS. 3 and 4, when a person is not lying in the bed, the top sheet 34 rests against the bottom sheet 36 and the band 32 lies generally folded against itself in an unstretched manner. However, when a person enters the bed as shown in FIG. 5, the band 32 stretches to allow the top sheet 34 to move relative to the bottom sheet 36 to accommodate the person's feet and not apply pressure thereto. In this manner, the bottom sheet 36 remains securely positioned around the mattress 20 with the top sheet 34 securely attached to the bottom sheet. Once the person leaves the bed, the stretchable band 32 will contract to its normal position and assist in pulling the top sheet 34 back to its normal position.

The principle and mode of operation of this invention have been described in its preferred embodiments. However, it should be noted that this invention may be practiced otherwise than as specifically illustrated and described without departing from its scope.

What is claimed is:

1. A bedsheet combination comprising:

a bottom sheet having a fitted foot end of non-stretchable fabric;

a top sheet having a foot end; and a connector band of stretchable fabric secured between the bottom sheet and the top sheet to attach the foot end of the top sheet to the foot end of the bottom sheet, the connector band having a first edge attached to the foot end of the bottom sheet and having a second edge attached to the foot end of the top sheet, wherein the connector band enables the foot end of the top sheet to be pulled away from the foot end of the bottom sheet while being urged to return in the direction of the foot end of the bottom sheet.

2. The bedsheet combination of claim 1 in which the connector band is continuous across the foot end of the bottom sheet and the foot end of the top sheet.

3. The bedsheet combination of claim 1 wherein the top sheet includes a first seam defining a first pocket and a second seam defining a second pocket, where the first and second pockets are shaped to be fitted around the corners of a mattress.

4. The bedsheet combination of claim 1 wherein the width of the connector band, when unstretched, is within the range of from about 2 inches to about 12 inches.

5. The bedsheet combination of claim 1 wherein the band is made from a fabric that includes about 90% polyester material and about 10% elastic-based material.

6. The bedsheet combination of claim 1 wherein the band is made from a fabric that includes less than about 50 percent of elastic-based material.

7. The bedsheet combination of claim 1 in which the connector band is stretchable to increase its width by an amount within the range of from about 50 percent to about 150 percent of the original width.

8. The bedsheet combination of claim 7 in which the connector band is stretchable to increase its width by an amount within the range of from about 75 percent to about 125 percent of the original width.

9. The bedsheet combination of claim 7 in which the connector band is stretchable to increase its width by about 100 percent of the original width.

10. The bedsheet combination of claim 7 in which the connector band is continuous across the foot end of the bottom sheet and the foot end of the top sheet, the top sheet includes a first seam defining a first pocket and a second seam defining a second pocket, where the first and second pockets are shaped to be fitted around the comers of a mattress, and the band is made from a fabric that includes about 90% polyester material and about 10% elastic-based material.

11. A bedsheet combination comprising:

a bottom sheet having a first side edge and a foot end;

a top sheet having a first side edge and a foot end; and a connector band of stretchable fabric secured between the bottom sheet and the top sheet to attach the foot end of the top sheet to the foot end of the bottom sheet and to attach the first side edge of the top sheet to the first side edge of the bottom sheet, the connector band having and end panel and a side panel, with the end panel of the connector band having a first edge attached to the foot end of the bottom sheet and having a second edge attached to the foot end of the top sheet, and with the side panel of the connector band having a first panel edge attached to the first side edge of the bottom sheet, and the side panel of the connector band having a second panel edge attached to the first side edge of the top sheet, wherein the connector band enables the foot end of the top sheet to be pulled away from the foot end of the bottom sheet while being urged to return in the direction of the foot end of the bottom sheet, and enables the first side edge of the top sheet to be pulled away from the first side edge of the bottom sheet while being urged to return in the direction of the first side edge of the bottom sheet.

12. The bedsheet combination of claim 11 in which the length of the side panel of the connector band is within the range of from about 25 percent to about 80 percent of the length of the bottom sheet.

13. The bedsheet combination of claim 11 wherein the width of the connector band, when unstretched, is within the range of from about 2 inches to about 12 inches.

14. The bedsheet combination of claim 11 in which the connector band is stretchable to increase its width by an amount within the range of from about 50 percent to about 150 percent of the original width.

15. The bedsheet combination of claim 14 in which the connector band is stretchable to increase its width by an amount within the range of from about 75 percent to about 125 percent of the original width, the top sheet includes a first seam defining a first pocket and a second seam defining a second pocket, where the first and second pockets are shaped to be fitted around the corners of a mattress, and the band is made from a fabric that includes about 90% polyester material and about 10% elastic-based material, and the length of the side panel of the connector band is within the range of from about 25 percent to about 80 percent of the length of the bottom sheet.

16. A bedsheet combination comprising:

a bottom sheet having a first side edge, a second side edge and a foot end;

a top sheet having a first side edge, a second side edge and a foot end; and a connector band of stretchable fabric secured between the bottom sheet and the top sheet to attach the foot end of the top sheet to the foot end of the bottom sheet, to attach the first side edge of the top sheet to the first side edge of the bottom sheet, and to attach the second side edge of the top sheet to the second side edge of the bottom sheet, the connector band having an end panel, a first side panel and a second side panel, with the end panel of the connector band having a first edge attached to the foot end of the bottom sheet and having a second edge attached to the foot end of the top sheet, with the first side panel of the connector band having a first panel edge attached to the first side edge of the bottom sheet, and the side panel of the connector band having a second panel edge attached to the first side edge of the top sheet, the second side panel of the connector band having a first panel edge attached to the second side edge of the bottom sheet, and the second side panel of the connector band having a second panel edge attached to the second side edge of the top sheet, wherein the connector band enables the foot end of the top sheet to be pulled away from the foot end of the bottom sheet while being urged to return in the direction of the foot end of the bottom sheet, and enables the first side edge of the top sheet to be pulled away from the first side edge of the bottom sheet while being urged to return in the direction of the first side edge of the bottom sheet, and enables the second side edge of the top sheet to be pulled away from the second side edge of the bottom sheet while being urged to return in the direction of the second side edge of the bottom sheet.

17. The bedsheet combination of claim 16 in which the length of the side panel of the connector band is within the range of from about 25 percent to about 80 percent of the length of the bottom sheet.

18. The bedsheet combination of claim 16 in which the first side panel of the connector band has a length that is within the range of from about 1.5 to about 5 times the length of the second side panel of the connector band.

19. The bedsheet combination of claim 18 in which the connector band is stretchable to increase its width by an amount within the range of from about 50 percent to about 150 percent of the original width.

20. The bedsheet combination of claim 18 in which the length of the side panel of the connector band is within the range of from about 25 percent to about 80 percent of the length of the bottom sheet, and in which the connector band is stretchable to increase its width by an amount within the range of from about 50 percent to about 150 percent of the original width.

* * * * *